US007762024B1

(12) United States Patent
Resech

(10) Patent No.: US 7,762,024 B1
(45) Date of Patent: Jul. 27, 2010

(54) POCKET SEAL FOR ROOF

(76) Inventor: Ronald W. Resech, 67 Country Club Dr., Bloomingdale, IL (US) 60108

( * ) Notice: Subject to any disclaimer, the term of this patent is extended or adjusted under 35 U.S.C. 154(b) by 0 days.

(21) Appl. No.: 12/582,868

(22) Filed: Oct. 21, 2009

Related U.S. Application Data

(63) Continuation of application No. 12/495,290, filed on Jun. 30, 2009.

(51) Int. Cl.
*E04D 13/14* (2006.01)
*E04D 1/36* (2006.01)

(52) U.S. Cl. ..... 52/60; 52/98; 52/219

(58) Field of Classification Search ..... 52/58, 52/60, 98, 100, 219; 285/42
See application file for complete search history.

(56) References Cited

U.S. PATENT DOCUMENTS

| | | | | |
|---|---|---|---|---|
| 957,980 A | | 5/1910 | Mikesell | |
| 1,411,352 A | * | 4/1922 | Hawksworth | 52/60 |
| 1,762,896 A | | 6/1930 | Sherlock | |
| 2,226,354 A | | 12/1940 | Barr | |
| 2,800,850 A | * | 7/1957 | McKann | 454/3 |
| 2,985,091 A | | 5/1961 | Hatcher | |
| 3,838,544 A | | 10/1974 | Hindall | |
| 4,333,660 A | | 6/1982 | Cupit | |
| 4,563,847 A | * | 1/1986 | Hasty | 52/219 |
| 4,570,943 A | | 2/1986 | Houseman | |
| 4,635,409 A | * | 1/1987 | Vandemore | 52/60 |
| 4,837,991 A | * | 6/1989 | Shaw | 52/98 |
| 4,903,997 A | | 2/1990 | Kifer | |
| 4,928,443 A | | 5/1990 | Goodman | |
| 4,934,117 A | * | 6/1990 | Barksdale | 52/219 |
| 4,937,991 A | | 7/1990 | Orth | |
| 5,018,748 A | | 5/1991 | Schalle | |
| 5,309,579 A | * | 5/1994 | Nelson | 4/252.1 |
| 5,493,827 A | | 2/1996 | Georgeau | |
| 5,518,277 A | | 5/1996 | Sanders | |
| 5,588,267 A | * | 12/1996 | Rodriguez et al. | 52/219 |
| 5,605,019 A | | 2/1997 | Maziekien | |
| 5,768,838 A | | 6/1998 | Georgeau | |
| 5,899,034 A | | 5/1999 | Vermilion | |
| 6,021,620 A | | 2/2000 | Vermilion | |
| 6,691,473 B1 | | 2/2004 | Mayle | |
| 6,848,220 B2 | * | 2/2005 | Faurholdt et al. | 52/58 |

(Continued)

FOREIGN PATENT DOCUMENTS

CA 640736 A 5/1962

(Continued)

OTHER PUBLICATIONS

Versico Roofing Systems, product information sheet, © 2008 Versico, LLC.

(Continued)

*Primary Examiner*—Brian E Glessner
(74) *Attorney, Agent, or Firm*—Robert L. Marsh

(57) ABSTRACT

An adjustable size pitch pocket is formed by assembling together two identical pocket members to form a whole pocket. Each pocket member has a U-shaped vertical wall with a short wall section and a parallel long wall section. The long wall section has transverse scorings for cutting the length of the long walls of two mated pocket members to form a pocket of a desired size.

4 Claims, 3 Drawing Sheets

U.S. PATENT DOCUMENTS

| | | | | |
|---|---|---|---|---|
| 6,892,499 | B1 | 5/2005 | Mayle | |
| 6,892,782 | B1 | 5/2005 | Mayle | |
| 6,941,713 | B2 * | 9/2005 | Williams | 52/302.6 |
| 7,387,149 | B1 | 6/2008 | Mayle | |
| 2003/0014926 | A1 | 1/2003 | Champa | |
| 2005/0028456 | A1 | 2/2005 | McLane | |
| 2005/0172569 | A1 | 8/2005 | Jutras | |
| 2007/0272341 | A1 | 11/2007 | Khan | |
| 2008/0085336 | A1 | 4/2008 | Mayle | |

FOREIGN PATENT DOCUMENTS

| | | |
|---|---|---|
| GB | 1310003 | 1/1971 |
| WO | WO 85/ 04923 A1 | 4/1985 |

OTHER PUBLICATIONS

GAF® Materials Corporation, EverGuard™ PVC Accessories, Product Data Sheets 15 and 16.

Pitch Pocket 4040 New Construction or Reroof, Prefabricated Custom Curb Flashing © 1998.

The Pate Company, Patecurbs Product Catalog © 1996-2008.

* cited by examiner

POCKET SEAL FOR ROOF

The present application is a continuation of the applicant's co-pending application filed Jun. 30, 2009 and assigned Ser. No. 12/495,290. The present invention relates to a pocket seal for sealing around projecting elements in a roof and to an improved member for forming a pocket for a seal.

BACKGROUND OF THE INVENTION

It is common for a flat roof, that is a roof having a surface that is substantially horizontal, to support various other structures such as air conditioners, heaters, signage, vents, stacks, and so forth. Such structures include support elements that extend through the surface of a generally horizontal roof and require a seal around the base of the projecting support element where it penetrates the roof with the seal binding to a portion of the element that extends vertically from the surface of the roof and binding to the water resistant roofing material. The seal prevents water and the like from the environment from penetrating the roofing material at the base of the projecting element.

To seal the base of a projecting element against the roof, it is common to provide a "pitch pan" or a "pitch pocket". The pitch pocket consists of a frame around the base of the projecting element and above the waterproofing material that protects the roof against rainwater and the like. The frame is then filled with an appropriate sealing material such as a tar and forms an insulating mass around the base of the projecting element thereby preventing water from the elements from working its way below the layer of roofing material.

Originally, pitch pockets and the like were formed by cutting metal cans of the type used to retain coffee and the like or of sheet metal. The pitch pockets were configured with an upstanding wall that surrounds the perimeter of a projecting element extending through a roof and a flange extending radially outwardly of the wall. The enclosure formed by the wall would then be filled with the sealing material a portion of which would be applied over the radial flange to assist in retaining the metal enclosure to the roof of the building. The formation of an enclosure suitable for a pitch pocket has been time consuming and in many cases the end product has been unsatisfactory. There has therefore been a demand for a commercially available pitch pocket.

Several forms of commercial pitch pockets are available. For example, Goodman, U.S. Pat. No. 4,928,443 discloses a pocket formed by a elongate strip with a male connector at one end and a female connector at the other end such that the strip can be wrapped around a projecting element and the ends connected to form a circular enclosure. Orth, U.S. Pat. No. 4,937,991 discloses the use of two identical upwardly projecting half-cylinders that can be assembled around a projecting element to form a pitch pocket. Barksdale, U.S. Pat. No. 4,934,117 also discloses the use of a ring to form a pitch pocket. One drawback regarding all the forgoing prior art devices is that the pitch pocket formed is of a predetermined size that can neither can be constricted to seal around a small projecting element nor expanded to seal around a larger projecting element.

Georgeau, U.S. Pat. Nos. 5,493,827 and 5,768,838 both disclose the use of blocks of various sizes including longitudinal blocks and corner blocks that can be glued end to end to form a pitch pocket of any desired size. Georgeau requires that a roofer maintain on hand blocks of many different sizes and shapes. Hindall, U.S. Pat. No. 3,838,544 discloses the use of a plurality of metal parts that can be assembled together to form a pitch pocket of a desired size. Like Georgeau, the Hindall device also requires that a roofer maintain parts of various sizes and shapes in order to assemble a pitch pocket of any desired size.

It would be desirable, therefore, to provide a durable, simple to use part, any two of which could be assembled to each other to form a pitch pocket that would not be limited to a single size, but could be enlarged or reduced in size as needed.

SUMMARY OF THE INVENTION

Briefly, the present invention is embodied in a pocket member, any two of which can be assembled together to form a single pitch pocket that will surround a projecting element that extends through a roof for sealing against leakage under a layer of roofing material. A pocket member in accordance with the invention has a generally U-shaped vertical wall including a short wall section and a long wall section extending parallel to and spaced from the short wall section and a central wall section extending from one end of the short wall section to one end of the long wall section. In accordance with the invention, the long wall section has a plurality of spaced apart scores along the length thereof with each of the scores extending perpendicular to the length. A planar base extends from the lower edge of the vertical wall and defines a plane perpendicular to the wall. In the preferred embodiment, the short wall section is horizontally offset by the width of the long wall section such that a portion of the long wall section of a second pocket can be aligned adjacent the short wall section of a first pocket wherein the first and second pocket members are assembled to each other to form a single pitch pocket.

In use, the long wall section of both the first and second pocket members are cut along one of the score lines to form a long wall section of a desired length. Thereafter, the first and second pocket members are assembled around the projecting element with a portion of the shortened long wall section of the first pocket member overlapping the offset short wall of the second pocket member and a portion of the shortened long wall section of the second pocket member overlapping the offset short wall section of the first pocket member and the bases of the two sections positioned against the flexible roofing material.

Heat welding or an adhesive, or the like, is then used to bond the overlapping portions of the long wall sections against the adjacent short wall sections and to bond the base portions against the flexible roofing material. The pocket formed by the assembled pocket members is then filled with a liquefied sealant material that is permitted to harden. After hardening, the pocket will seal the exterior of the projecting element to the surrounding roofing material and thereby prevent leakage of water around the projecting element and underneath the roofing material.

BRIEF DESCRIPTION OF THE DRAWINGS

A better understanding of the invention will be had after a reading of the following detailed description taken in conjunction with the drawings wherein.

DETAILED DESCRIPTION OF PREFERRED EMBODIMENT

Figure 1:
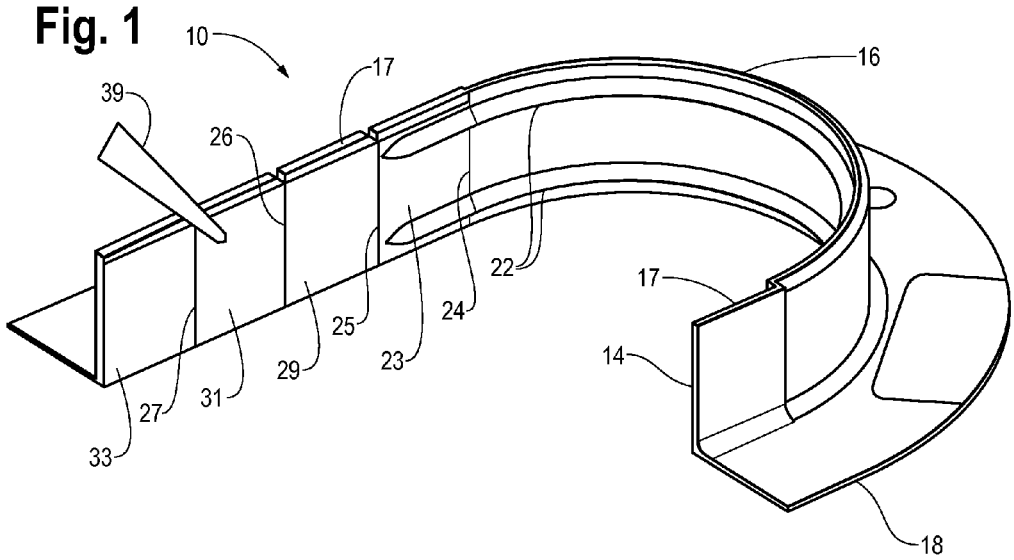
FIG. 1 is an isometric view of a pocket member in accordance with the present invention.

Referring to FIGS. 1 through 5, a pocket member 10 in accordance with the present invention is made of any suitable material, preferably a plastic or vinyl with elastomeric qualities such as TPO or PVC, with a derometer that provides a degree of flexible so as to not readily fracture when being assembled. The pocket member 10 when oriented for use has a vertically upwardly extending wall that has a generally U-shaped configuration including a long wall section 12, a short wall section 14, and a arcuate central wall section 16 extending from one end of the long wall section 12 to one end of the short wall section 14. Extending radially outward from the lower edge of all three sections 12, 14, 16 of the pocket member 10 is a radially extending planar base panel 18 having an outer edge 20 spaced a fixed distance, preferably at least one and one-half inches from the outer surface of the adjacent wall section 12, 14, 16, with the planar base panel 18 being generally perpendicular to the adjacent wall section 12, 14, 16. To provide rigidity to the various wall sections 12, 14, 16, one or more ribs 22 are provided along the inner surface of the wall sections 12, 14, 16.

In the preferred embodiment, the wall sections 12, 14, 16 all have a common upper edge 17 that extends parallel to the plane of the base section 18 and defines a wall height of one and one-half inches or more.

Figure 2:
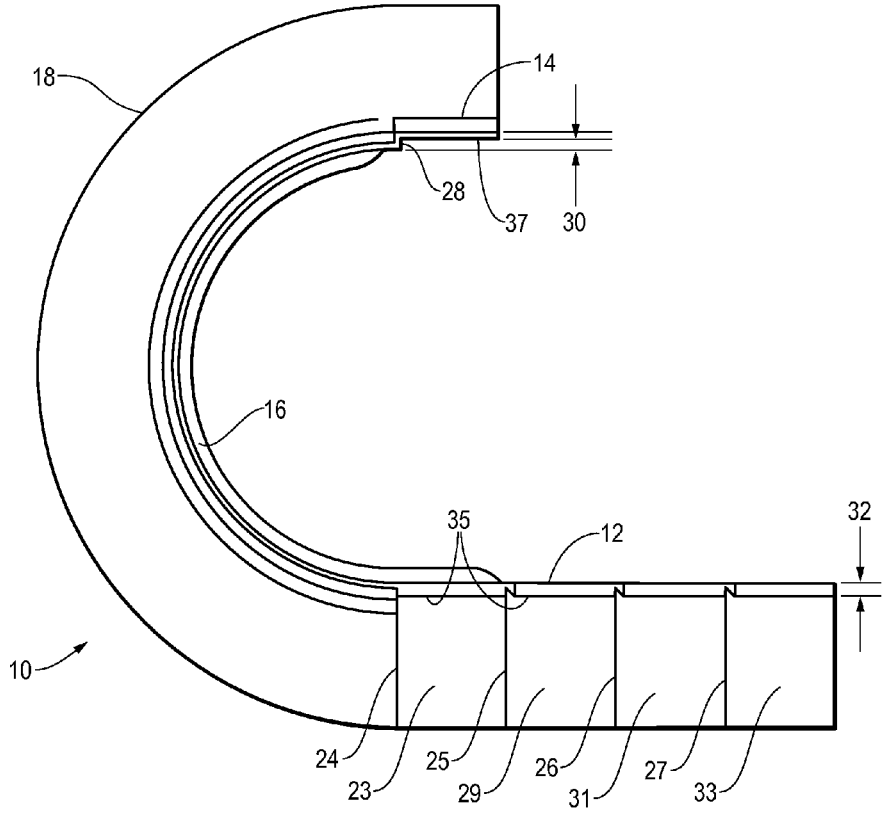
FIG. 2 is a top view of the pocket member shown in FIG. 1.
Figure 3:
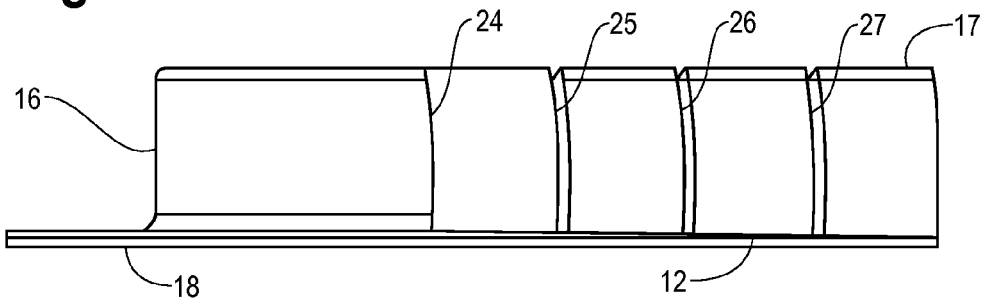
FIG. 3 is a side view showing the long side of the pocket shown in FIG. 1.
Figure 4:
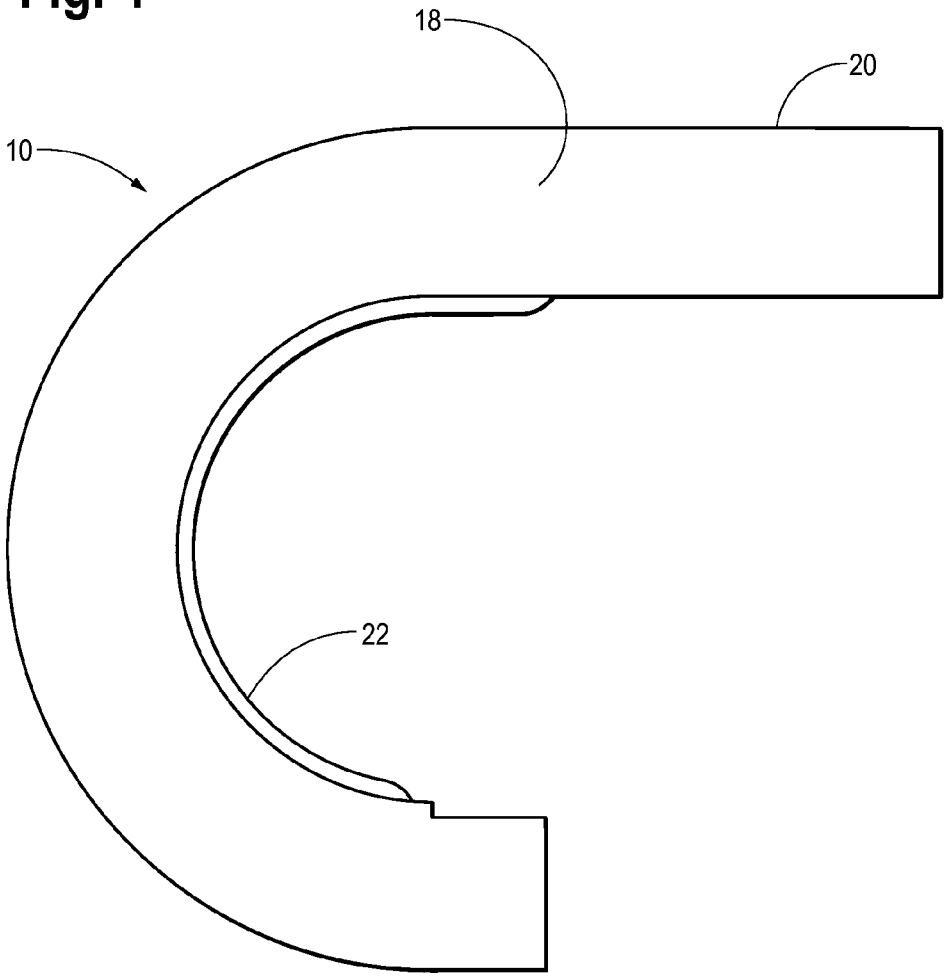
FIG. 4 is a bottom view of the pocket member shown in FIG. 1.
Figure 5:
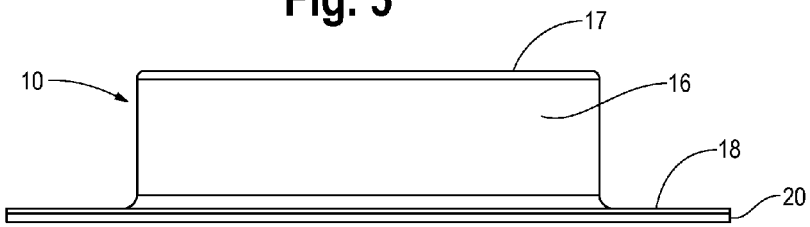
FIG. 5 is an end view of the pocket shown in FIG. 1.

As best shown in FIGS. 1 and 2, the long wall section 12 is linear and has a plurality of transverse spaced apart score lines 25, 26, 27 that extend across the long wall section 12 and the adjacent base panel 18 that divide the long wall section 12 into a plurality of small portions 29, 31, 33. Preferably, each score line 25-27 defines a reduction of about one-half of the thickness of the long wall section 12 to thereby facilitate cutting of the long wall section 12 along any one of the score lines 25-27. Accordingly, the length of the long wall section 12 can be shortened by cutting the long wall section at any one of the score lines 25-27 to thereby remove one or more of the small portions 29, 31, 33.

Figure 6:
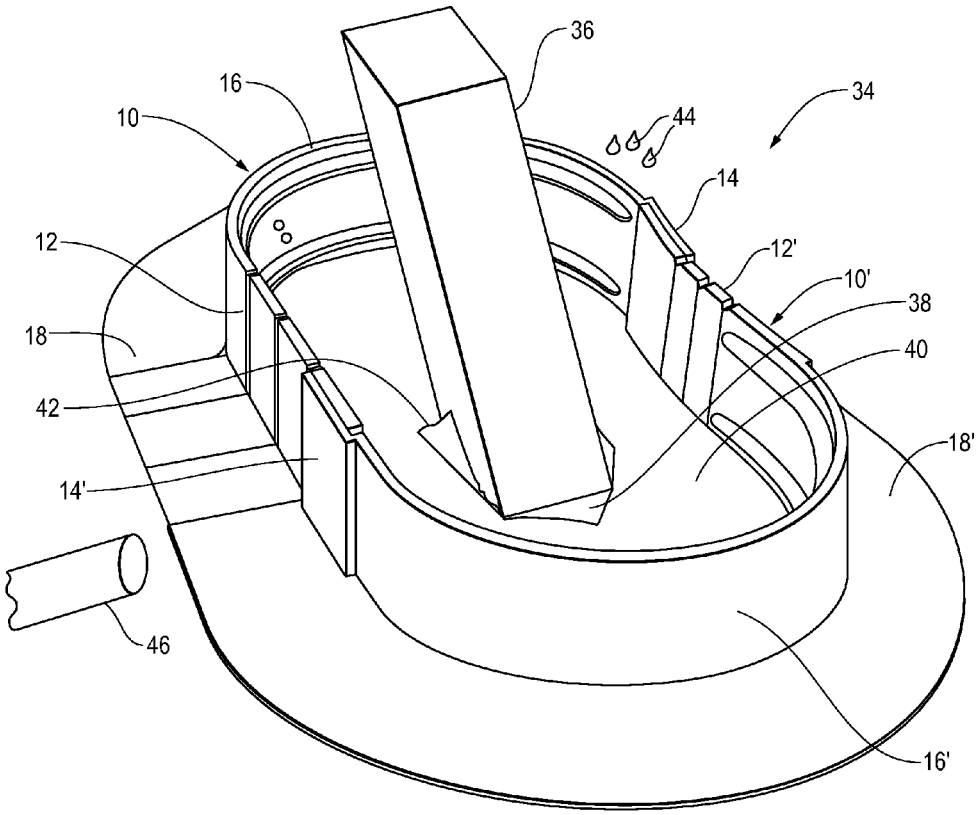
FIG. 6 is an isometric view of two pocket members as shown in FIG. 1 assembled together to form a single pocket.

As best shown in FIGS. 2 and 6, the short wall section 14 has an offset 28 displacing the short wall section 14 radially outwardly a distance 30 that is approximately equal to the thickness 32 of the long wall section 12. The offset 28 permits a first pocket member 10 to be assembled to a second pocket member 10' with the end portion of long wall section 12 of the first pocket member 10 adjacent the short wall section 14' of the second pocket member 10' and the long wall section 12' of the second pocket member 10' assembled against the short wall section 14 of the first pocket member 10. End portions of the base panels 18 and 18' also overlap each other to form a single pocket 34 to enclose a projecting element 36 that extends through a roof 38 having a planar panel of flexible roofing material 40 thereon.

Between the arcuate central wall 16 and the first score line 25, the long wall section 12 also has a short transition portion 23 having an overall length of one and one half inches or more. The outer surface 35 of the transition portion 23 and the outer surfaces of the small portions 29, 31, 33 are planar as is the inner surface 37 of the short wall section 14 thereby permitting the entire outer surface 35 of an outer end portion 23, 29, 31, 33 of one pocket member 10 to contact the adjacent surface of pocket member 10' that is identical to surface 37 of pocket member 10. The junction 24 between the arcuate central wall 16 and the transition portion 23 is abrupt forming a visible line.

As shown in FIGS. 1 and 6, to assemble two pocket members 10, 10' to form a pocket 34, one of the score lines 25-27 of the first pocket member 10 and an equivalent score line of the second pocket member 10' are cut with any suitable tool 39 and the parts are assembled together around the projecting element 36 and the open edges 42 of the roofing material 40 applied to the upper surface of roof 38. The short wall section of each pocket member is bonded to the end portion of the long wall section of the other pocket member as is further described below. The base panels 18, 18' are thereafter heat welded or otherwise bonded to the roofing material 40 after which a liquefied sealant 44 is poured into the pocket 34 and allowed to harden into a single sealing mass. By cutting the long wall sections 12, 12' to minimum required lengths, the size of pocket formed is minimized and the amount of sealant 44 needed to fill the pocket is minimized.

Preferably, each short wall section 14 has a length of at least one and one-half inches so as to provide enough wall area to form a good heat weld to an end portion of the long wall 12' of the companion pocket member 10'. A suitable heat source, such as a hot air gun made by Leister Process Technologies or a torch 46 is then used to heat the overlapping surfaces and thereby form a heat weld bonding short wall section 14 to the end portion of the long wall section 12' and short wall section 14' to the end portion of the long wall section 12. When the pocket member 10 is made of a TPO or a PVC, the material of which it is made will melt when it reaches a temperature between 400 degrees and 600 degrees Celsius. Heat from the torch 46 melts the outer surfaces of the overlapping parts of the pocket members 10, 10' and vulcanizes them to thereby bond them together. In similar fashion heat is applied to similarly bond the panels 18, 18' to the roofing material 40.

As can be seen, the present invention allows a roofer to maintain on hand a supply of pocket members 10, all of which are identical, thereby reducing the inventory required to be kept on hand to form a pocket around a projecting element 36 extending through a roof 38.

It should be appreciated that even though the central section 16 of the wall has been shown and described as being arcuate, the central section 16 could be formed as a planar wall connecting one end of the short wall section 14 to one end of the long wall section 12.

While the present invention has been described with respect to a single embodiment, it will be appreciated that many modifications and variations may be made without departing from the spirit and scope of the invention. It is therefore the intent of the appended claims to cover all such modifications and variations that fall within the spirit and scope of the invention.

What is claimed:

1. The combination comprising a first and an identical second unitary pocket member wherein each of said pocket members includes a vertical wall including a short wall section, a long wall section extending parallel to said short wall section and spaced therefrom, and a central wall section extending from one end of said short wall section to one end of said long wall section, said long wall section having a plurality of spaced apart scores therein along a length thereof with each of said scores extending perpendicular to said length wherein said long wall section is shortenable to a chosen length by cutting along one of said scores, a continuous planar base extending from a lower edge of all sections of said vertical wall and defining a plane perpendicular to said wall, and said short wall section having an offset for receiving one end portion of a long wall section of another pocket member, said first and second pocket members positioned around a projection with a portion of said shortenable long wall section of said first pocket member overlapping said offset short wall section of said second pocket member, a portion of said shortenable long wall section of said second pocket member overlapping said offset short wall section of said first pocket member and a portion of said base of said first pocket member overlapping a portion of said base of said second pocket member, and said overlapping portions of said first and second pocket members bonded together to form a pocket.

2. The combination of claim 1 wherein said overlapping portions are heat welded together.

3. The combination of claim 1 and further comprising, a portion of a roof, a film of flexible roofing material on said roof, said projecting element extending through said roof and said film, said pocket around said projecting element, and a sealing filler in said pocket to seal said projecting element to said film and prevent leakage of water through said film to said roof.

4. The combination of claim 1 wherein each of said long wall sections includes a scoring wherein said long wall section is shortenable to a length equal to a length of said short wall section.

* * * * *